US010173107B2

(12) United States Patent
Norimura et al.

(10) Patent No.: US 10,173,107 B2
(45) Date of Patent: Jan. 8, 2019

(54) GOLF CLUB HEAD

(71) Applicant: SUMITOMO RUBBER INDUSTRIES, LTD., Kobe-shi, Hyogo (JP)

(72) Inventors: Takahiro Norimura, Kobe (JP); Daisuke Kohno, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/299,625

(22) Filed: Oct. 21, 2016

(65) Prior Publication Data

US 2017/0113106 A1 Apr. 27, 2017

(30) Foreign Application Priority Data

Oct. 23, 2015 (JP) ..... 2015-208699

(51) Int. Cl.
*A63B 53/04* (2015.01)

(52) U.S. Cl.
CPC ..... *A63B 53/0475* (2013.01); *A63B 53/047* (2013.01); *A63B 53/04* (2013.01); *A63B 53/0466* (2013.01); *A63B 2053/042* (2013.01); *A63B 2053/0408* (2013.01); *A63B 2053/0416* (2013.01); *A63B 2053/0433* (2013.01); *A63B 2053/0458* (2013.01); *A63B 2053/0462* (2013.01); *A63B 2053/0491* (2013.01)

(58) Field of Classification Search
CPC ..... A63B 2053/0416; A63B 2053/042; A63B 2053/0462; A63B 2053/0458; A63B 2053/0408; A63B 53/04; A63B 53/047; A63B 53/0466
USPC ..... 473/342, 324, 349
See application file for complete search history.

(56) References Cited

U.S. PATENT DOCUMENTS

| | | | | |
|---|---|---|---|---|
| 6,517,448 | B1 | 2/2003 | Takeda | |
| 7,112,147 | B2 * | 9/2006 | Solheim | A63B 53/0487 473/340 |
| 2003/0064824 | A1 * | 4/2003 | Takeda | A63B 53/04 473/342 |
| 2005/0026717 | A1 * | 2/2005 | Jones | A63B 53/0487 473/340 |

FOREIGN PATENT DOCUMENTS

| | | | |
|---|---|---|---|
| JP | 2691496 | B2 | 12/1997 |
| JP | 10-277183 | A | 10/1998 |

* cited by examiner

*Primary Examiner* — Benjamin Layno
(74) *Attorney, Agent, or Firm* — Birch, Stewart, Kolasch & Birch, LLP

(57) ABSTRACT

A head 2 includes a head body h1 and a face plate p1 fixed to the head body h1. The face plate p1 includes a plate front surface f1 having a hitting face, a plate back surface b1, and a plate side surface s1. The head body h1 includes a body side surface v1 opposed to the plate side surface s1, and a receiving surface u1 which supports the face plate p1 from rear. A first contact part c1 is formed by contact between the body side surface v1 and the plate side surface s1. A hollow part sp1 is provided at a position adjacent to the first contact part c1.

14 Claims, 15 Drawing Sheets

GOLF CLUB HEAD

The present application claims priority on Patent Application No. 2015-208699 filed in JAPAN on Oct. 23, 2015, the entire contents of which are hereby incorporated by reference.

BACKGROUND OF THE INVENTION

Field of the Invention

The present invention relates to a golf club head.

Description of the Related Art

There has been known an iron type golf club head including a head body and a face plate attached to the head body. Japanese Patent No. 2691496 discloses a head, wherein a projection engaged with a recess of a face body to fix the face body to a head body is formed by the plastic deformation of a part of the head body.

SUMMARY OF THE INVENTION

A face plate is attached to an opening part of a head body. The present inventors have found that the attachment causes a delicate problem. Furthermore, as a result of much diligent research, the present inventors have found a structure capable of solving the problem.

It is an object of the present invention to provide a golf club head capable of suppressing the poor attachment of a face plate.

A preferable golf club head includes a head body and a face plate fixed to the head body. The face plate includes a plate front surface having a hitting face, a plate back surface which is a surface opposite to the plate front surface, and a plate side surface. The head body includes a body side surface opposed to the plate side surface, and a receiving surface which supports the face plate from rear. A first contact part is formed by contact between the body side surface and the plate side surface. A hollow part is provided at a position adjacent to the first contact part.

Preferably, a second contact part is formed by contact between the plate back surface and the receiving surface. Preferably, the hollow part is provided at a position adjacent to the second contact part.

Preferably, the face plate includes a lack part formed at a corner part between the plate side surface and the plate back surface. Preferably, the lack part forms the hollow part.

Preferably, the lack part is a chamfered part.

Preferably, the head body includes a first recess in the body side surface. Preferably, the first recess forms the hollow part.

Preferably, the head body includes a second recess in the receiving surface. Preferably, the second recess forms the hollow part.

Preferably, the hollow part is provided between the plate back surface and the receiving surface.

Preferably, shavings generated between the body side surface and the plate side surface exist in the hollow part.

DESCRIPTION OF THE PREFERRED EMBODIMENTS

Hereinafter, the present invention will be described in detail according to the preferred embodiments with appropriate references to the accompanying drawings.

In the present application, the following terms are defined.

[Base State]

The base state is in a state where a head is placed at a specified lie angle and real loft angle on a level surface h. In the base state, a center axis line (shaft axis line) of a shaft hole of the head is provided in a perpendicular plane VP1. The perpendicular plane VP1 is a plane perpendicular to the level surface h. In the base state, a face surface (hitting face) is inclined at a real loft angle with respect to the perpendicular plane VP1. The specified lie angle and real loft angle are described in, for example, a product catalog or the like.

[Toe-Heel Direction]

In the head of the base state, a direction of an intersection line between the perpendicular plane VP1 and the level surface h is the toe-heel direction. A toe side and a heel side used in the present application should be based on the toe-heel direction.

[Face-Back Direction]

A direction perpendicular to the toe-heel direction and parallel to the level surface h is the face-back direction. A face side and a back side used in the present application should be based on the face-back direction.

[Front-Rear Direction]

A direction perpendicular to the hitting face is defined as the front-rear direction. In other words, a normal direction of the hitting face is defined as the front-rear direction. Front and rear used in the present application should be based on the front-rear direction.

[Up-Down Direction]

A direction perpendicular to the toe-heel direction and parallel to the hitting face is the up-down direction. Above and below used in the present application should be based on the up-down direction.

Figure 1:
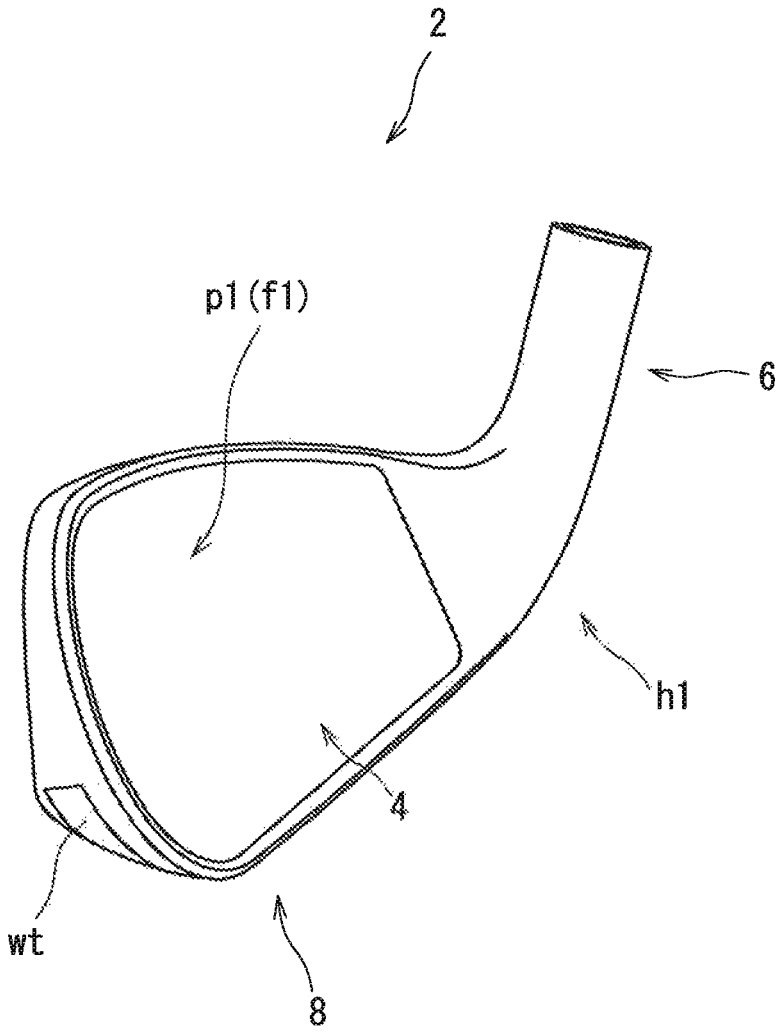
FIG. 1 is a perspective view of a golf club head of a first embodiment.
Figure 2:
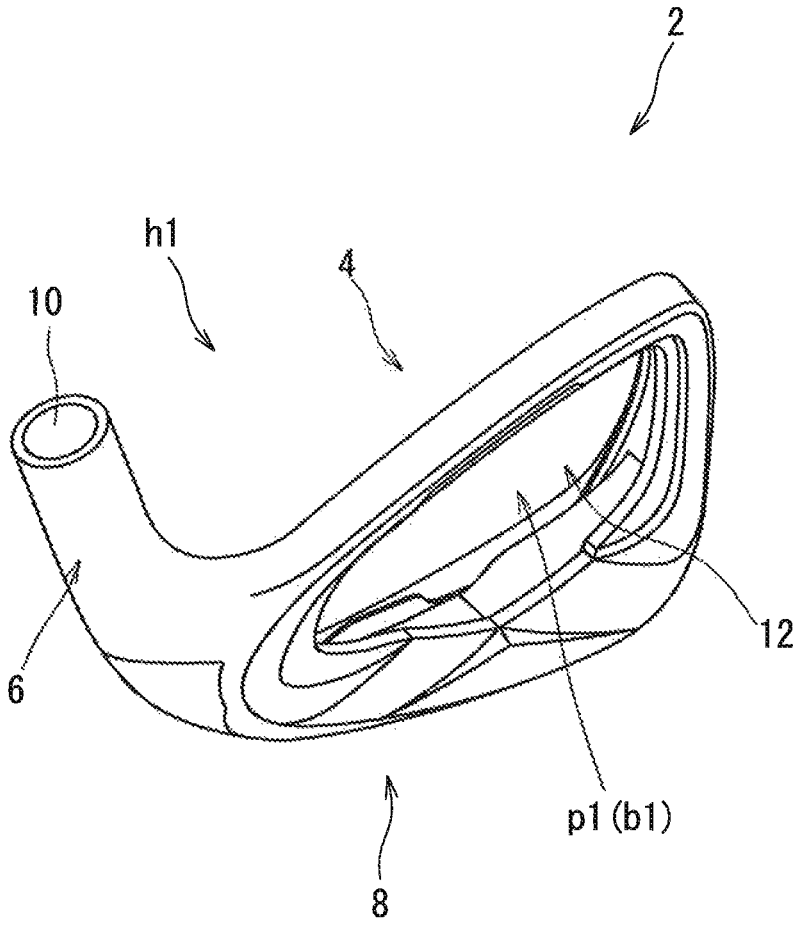
FIG. 2 is a perspective view showing the back surface of the head of FIG. 1.
Figure 3:
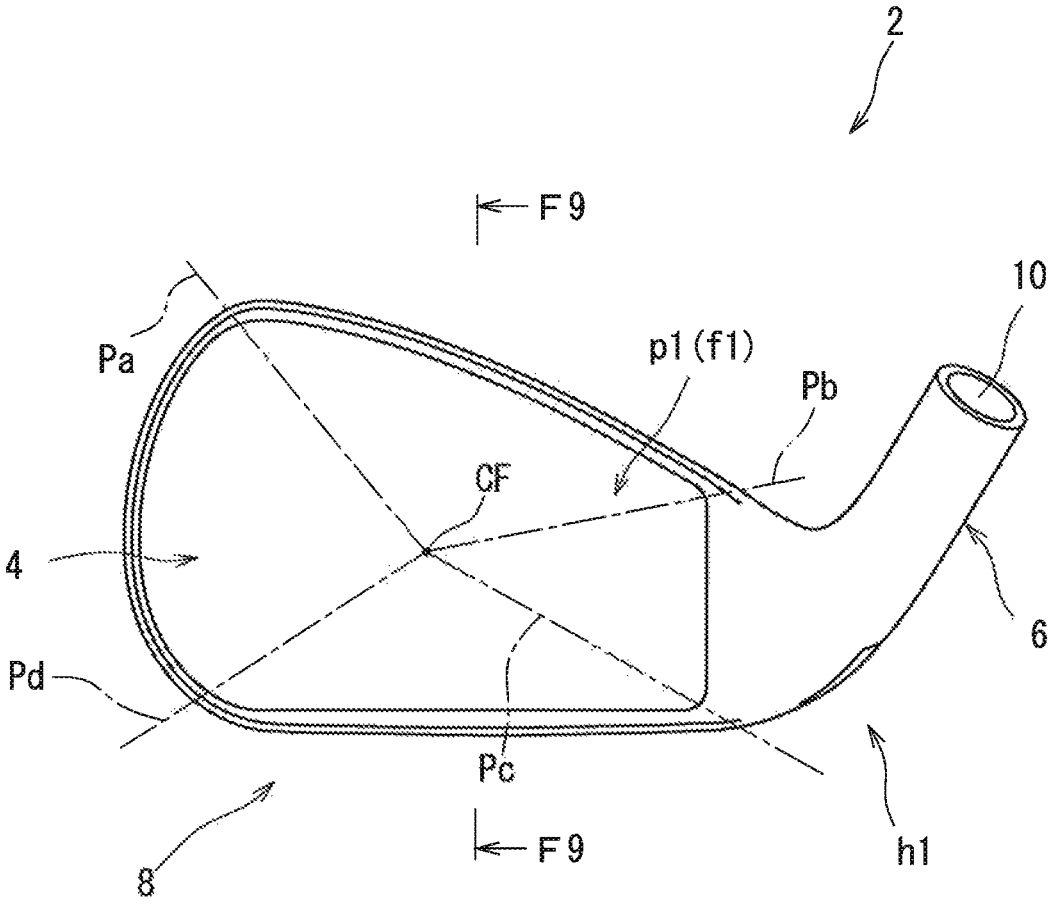
FIG. 3 is a front view of the head of FIG. 1.
Figure 4:
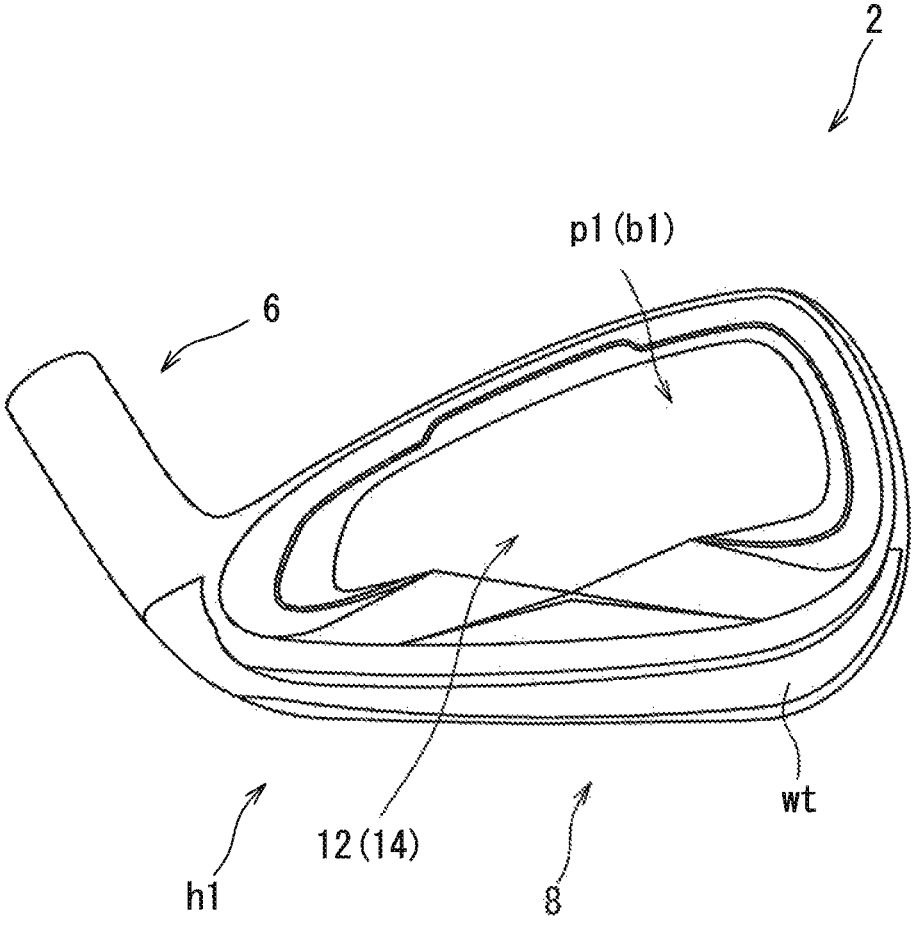
FIG. 4 is a back view of the head of FIG. 1.

FIG. 1 is a perspective view of a golf club head 2 according to a first embodiment of the present invention when the golf club head 2 is seen from an obliquely front side. FIG. 2 is a perspective view of the head 2 when the head 2 is seen from an obliquely rear side. FIG. 3 is a front view of the head 2. FIG. 3 is a view from the front of the hitting face. FIG. 4 is a back view of the head 2.

The head 2 includes a face 4, a hosel 6, and a sole 8. The hosel 6 has a hosel hole 10. The face 4 is the hitting face. Although face grooves is formed in the surface of the face 4, the description of the face grooves is omitted. A weight member wt is disposed in the sole 8. The head 2 is an iron type golf club head.

A back cavity 12 is provided on a side opposite to the face 4. The head 2 is a cavity back iron.

The head 2 includes a head body h1 and a face plate p1 fixed to the head body h1. The materials of the head body h1 and the face plate p1 are not limited. In the present embodiment, the head body h1 is made of a metal. In the present embodiment, the head body h1 is made of stainless steel. The face plate p1 is made of a metal. In the present embodiment, the face plate p1 is made of a titanium-based metal. The titanium-based metal means pure titanium or a titanium alloy.

The titanium alloy is an alloy containing 50% by weight or greater of titanium. Examples of the titanium alloy include α titanium, αβ titanium, and β titanium. Examples of the α titanium include Ti-5Al-2.5Sn and Ti-8Al-1V-1Mo. Examples of the αβ titanium include Ti-6Al-4V, Ti-6Al-2Sn-4Zr-6Mo, Ti-6Al-6V-2Sn, and Ti-4.5Al-3V-2Fe-2Mo. Examples of the β titanium include Ti-15V-3Cr-3Sn-3Al, Ti-20V-4Al-1Sn, Ti-22V-4Al, Ti-15Mo-2.7Nb-3Al-0.2Si, and Ti-16V-4Sn-3Al-3Nb. Examples of the pure titanium include industry pure titanium. Examples of the industry pure titanium include pure titanium of type 1, pure titanium of type 2, pure titanium of type 3, and pure titanium of type 4 which are prescribed by Japanese Industrial Standard.

Preferably, the specific gravity of the face plate p1 is smaller than the specific gravity of the head body h1. The face plate p1 having a smaller specific gravity contributes to the distribution of the weight of the head 2 to the circumference.

Figure 5A:
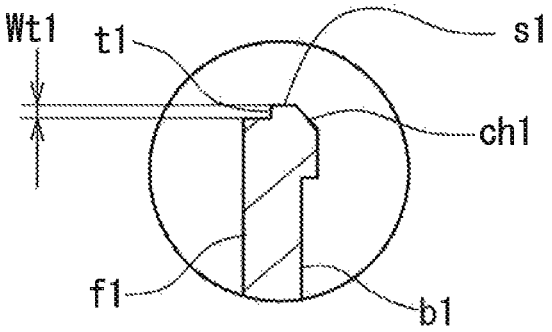
FIG. 5A is a sectional view taken along line 5A-5A in FIG. 5.
Figure 5:
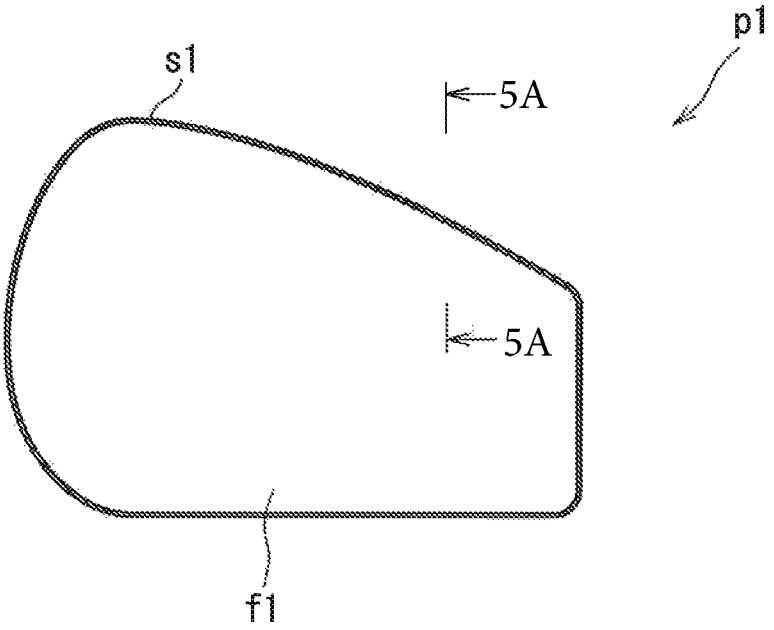
FIG. 5 is a plan view of a face plate according to the head of FIG. 1.
Figure 6A:
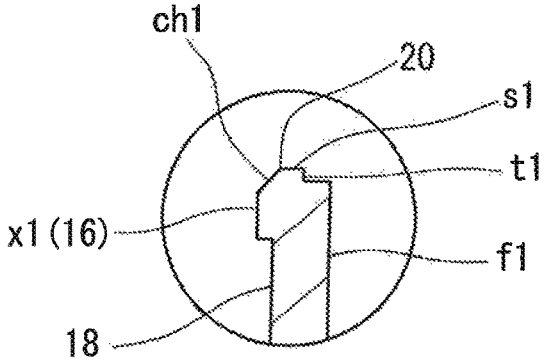
FIG. 6A is a sectional view taken along line 6A-6A in FIG. 6.
Figure 6:
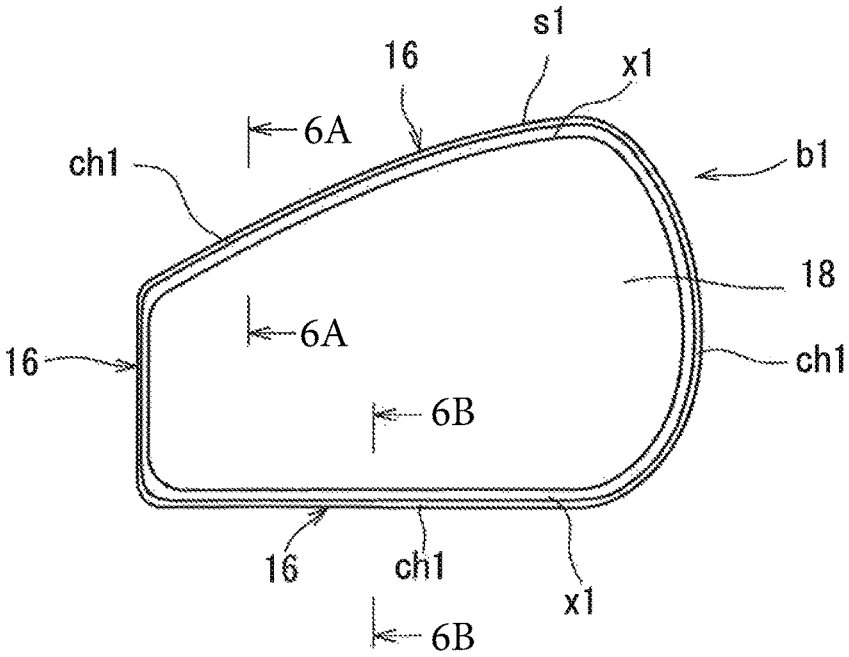
FIG. 6 is a back view of the face plate of FIG. 5.
Figure 6B:
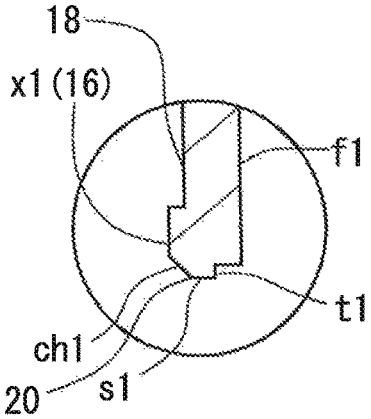
FIG. 6B is a sectional view taken along line 6B-6B in FIG. 6.

FIG. 5 is a plan view of the face plate p1. FIG. 5A is a sectional view taken along line 5A-5A in FIG. 5. FIG. 6 is a back view of the face plate p1. FIG. 6A is a sectional view taken along line 6A-6A in FIG. 6. FIG. 6B is a sectional view taken along line 6B-6B in FIG. 6. The face plate p1 includes a plate front surface f1, a plate back surface b1, and a plate side surface s1. The plate front surface f1 includes a hitting face. The hitting face is a plane except for face grooves. The plate back surface b1 is a surface opposite to the plate front surface f1. The plate side surface s1 extends between the plate front surface f1 and the plate back surface b1.

Figure 7:
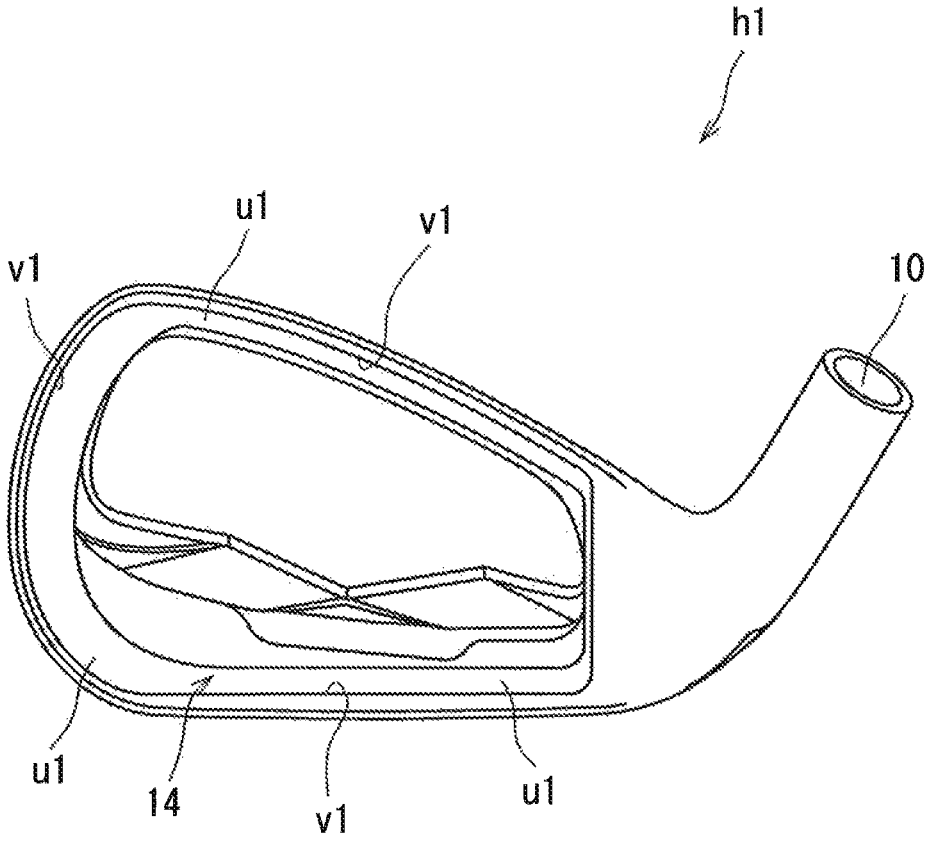
FIG. 7 is a front view of a head body according to the head of FIG. 1.

FIG. 7 is a front view of the head body h1. The head body h1 has an opening part 14. The contour of the opening part 14 is substantially equal to the contour of the face plate p1. The opening part 14 can accept the face plate p1 from front. The opening part 14 cannot accept the face plate p1 from rear.

The head body h1 includes a receiving surface u1 which supports the plate back surface b1 of the face plate p1, and a body side surface v1 which is opposed to the plate side surface s1. The head body h1 supports the face plate p1 (plate back surface b1) from rear. The whole receiving surface u1 is constituted by a single plane. The receiving surface u1 is provided over the whole circumference. The body side surface v1 is provided over the whole circumference of the opening part 14. A part of the plate back surface b1 is brought into contact with the receiving surface u1. In FIG. 7, the description of a plastic deforming part d1 (to be described later) is omitted.

The face plate p1 is press fitted into the opening part 14 of the head body h1. A pressing force remains between the body side surface v1 and the plate side surface s1. That is, the body side surface v1 and the plate side surface s1 press each other.

Figure 8:
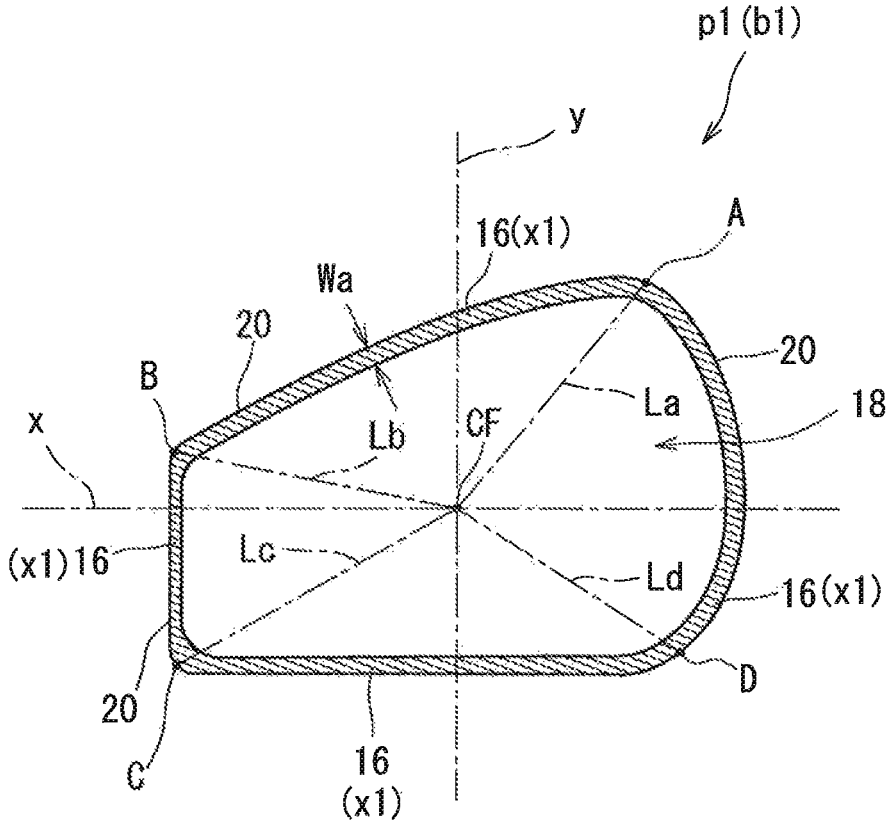
FIG. 8 is the same back view as FIG. 6, and an outer peripheral edge part is shown by hatching in FIG. 8.

FIG. 8 shows the plate back surface b1 as in FIG. 6. An outer peripheral edge part 16 is shown by hatching in FIG. 8. As shown in FIG. 8, the plate back surface b1 includes an outer peripheral edge part 16 having a circular shape, and an inner side part 18 located on the inner side of the outer peripheral edge part 16. The inner side part 18 is surrounded by the outer peripheral edge part 16.

The outer peripheral edge part 16 includes a contour line 20 of the plate back surface b1. That is, the outer contour line of the outer peripheral edge part 16 is the contour line 20. The outer peripheral edge part 16 has a width Wa. The width Wa is preferably equal to or greater than 1 mm, and more preferably equal to or greater than 1.3 mm. The width Wa is preferably equal to or less than 6 mm, and more preferably equal to or less than 5 mm.

A center of figure of the plate back surface b1 is shown by reference character CF in FIG. 8. The center of figure CF is determined based on the contour line 20 of the plate back surface b1.

In the plan view in FIG. 8, a straight line x and a straight line y are defined. The straight line x is a straight line passing through the center of figure CF and being parallel to the toe-heel direction. The straight line y is a straight line passing through the center of figure CF and being parallel to the up-down direction.

As shown in FIG. 8, the contour line 20 is sectioned into four by the straight line x and the straight line y. A point having the minimum curvature radius is determined in each of these four sections. A point having the smallest curvature radius in a toe upper side section is shown by reference character A. A point having the smallest curvature radius in a heel upper side section is shown by reference character B. A point having the smallest curvature radius in a heel lower side section is shown by reference character C. A point having the smallest curvature radius in a toe lower side section is shown by reference character D. A straight line which connects the point A and the center of figure CF is a straight line La. A straight line which connects the point B and the center of figure CF is a straight line Lb. A straight line which connects the point C and the center of figure CF is a straight line Lc. A straight line which connects the point D and the center of figure CF is a straight line Ld.

The head 2 may be comparted into four by three-dimensionally enlarging these straight lines. As shown in FIG. 3, a plane Pa including the straight line La and being perpendicular to the hitting face, a plane Pb including the straight line Lb and being perpendicular to the hitting face, a plane Pc including the straight line Lc and being perpendicular to the hitting face, and a plane Pd including the straight line Ld and being perpendicular to the hitting face are defined. The head 2 is comparted into a toe-side region, a heel-side region, a top-side region, and a sole-side region by these four planes Pa, Pb, Pc, and Pd. Therefore, for example, each of the head body h1 and the face plate p1 is also comparted into the toe-side region, the heel-side region, the top-side region, and the sole-side region. Thus, the four regions (toe-side region, heel-side region, top-side region, and sole-side region) in the present application are defined. The toe-side region, the heel-side region, the top-side region, and the sole-side region are generically referred to as a four-section region.

The four-section region is applied to all the portions of the head 2. For example, the plate side surface s1 is sectioned into the toe-side region, the heel-side region, the top-side region, and the sole-side region. For example, the receiving surface u1 is sectioned into the toe-side region, the heel-side region, the top-side region, and the sole-side region. For example, the body side surface v1 is sectioned into the toe-side region, the heel-side region, the top-side region, and the sole-side region.

At least a part of the outer peripheral edge part 16 forms a protruded part protruded to rear of the inner side part 18. The maximum thickness of the outer peripheral edge part 16 is greater than the thickness of the inner side part 18. As shown in FIG. 6, the outer peripheral edge part 16 is provided over the whole circumference of the face plate p1. A maximum protruded part x1 of the outer peripheral edge part 16 abuts on the receiving surface u1 of the head body h1. The inner side part 18 does not abut on the head body h1.

A protruded part corresponding to the outer peripheral edge part 16 can also be provided on the head body h1. However, when the specific gravity of the head body h1 is greater than the specific gravity of the face plate p1, the setting of the protruded part leads to an increase in a head weight. In addition, the shape of the head body h1 is more complicated than the shape of the face plate p1, the head body is less likely to subject the head body h1 to a process (for example, NC process). The face plate p1 has a plate shape, which is easily processed.

Figure 9:
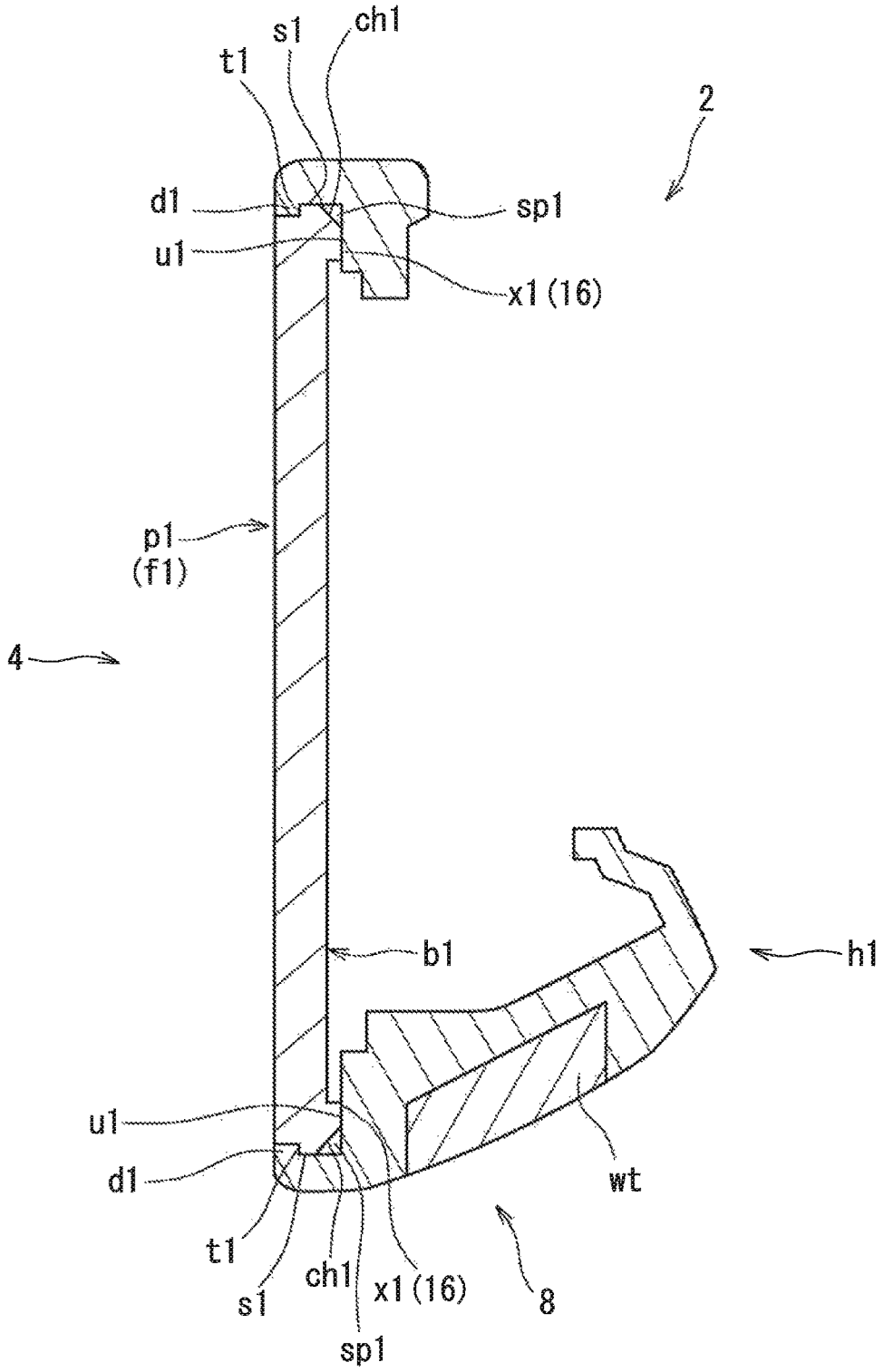
FIG. 9 is a sectional view taken along line F9-F9 of FIG. 3.

FIG. 9 is a sectional view taken along line F9-F9 of FIG. 3.

As shown in FIG. 9, at least a part of the outer peripheral edge part 16 abuts on the receiving surface u1. The outer peripheral edge part 16 includes the maximum protruded part x1 which abuts on the receiving surface u1. The maximum protruded part x1 abuts on the receiving surface u1. Only the maximum protruded part x1 abuts on the receiving surface u1. The inner side part 18 does not abut on the receiving surface u1.

As shown in FIG. 9, the head body h1 includes the plastic deforming part d1. The plastic deforming part d1 is located at front of the face plate p1.

Figure 10A:
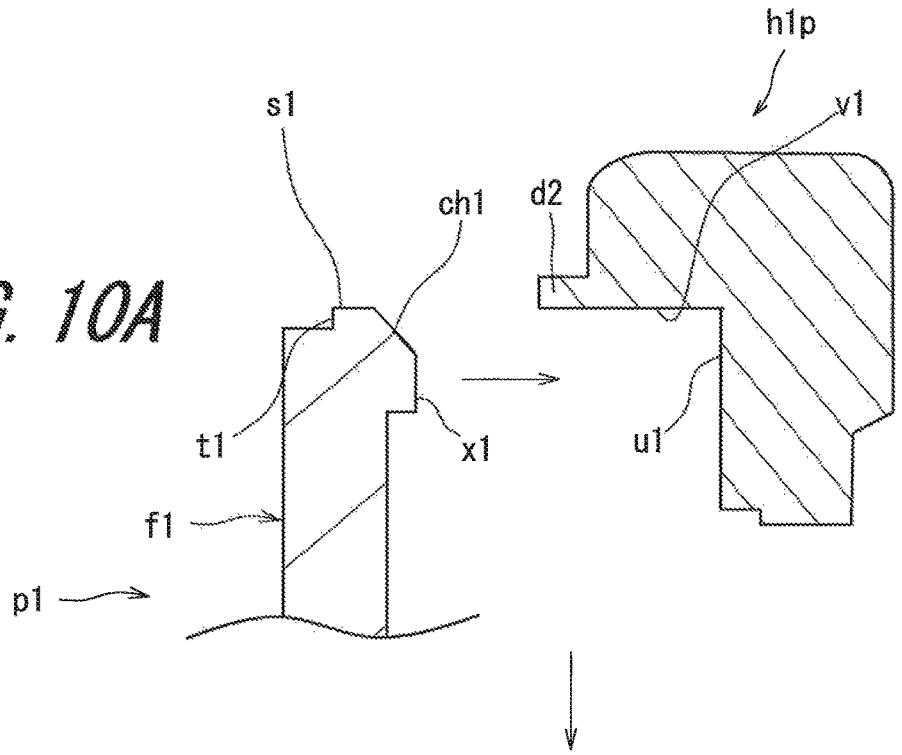
FIGS. 10A and 10B illustrate a step of press fitting.
Figure 10B:
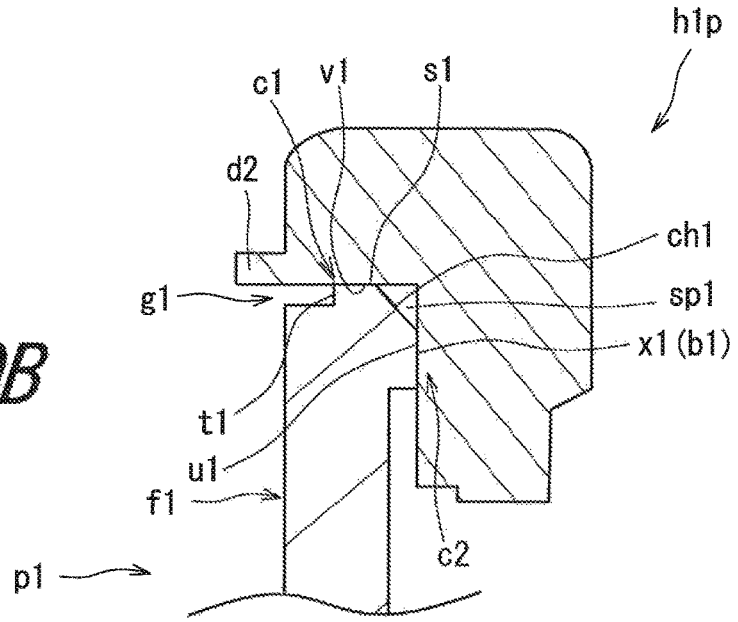
Figure 11A:
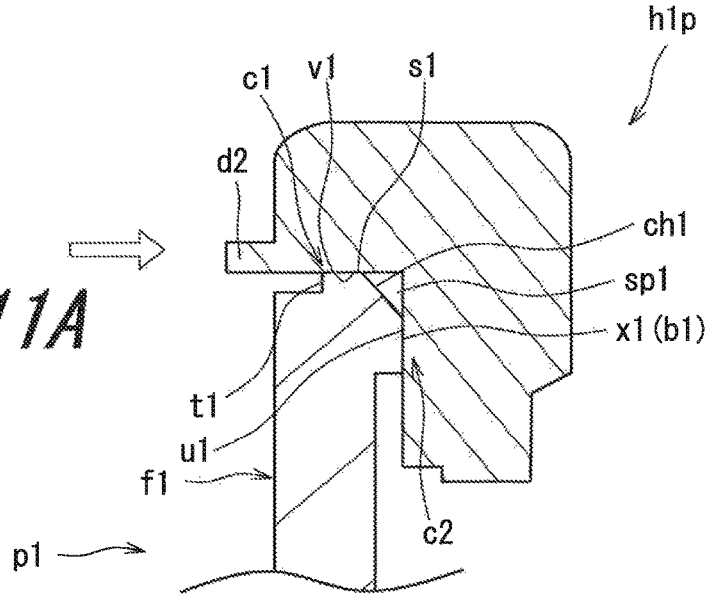
FIGS. 11A and 11B illustrate a step of caulking step.
Figure 11B:
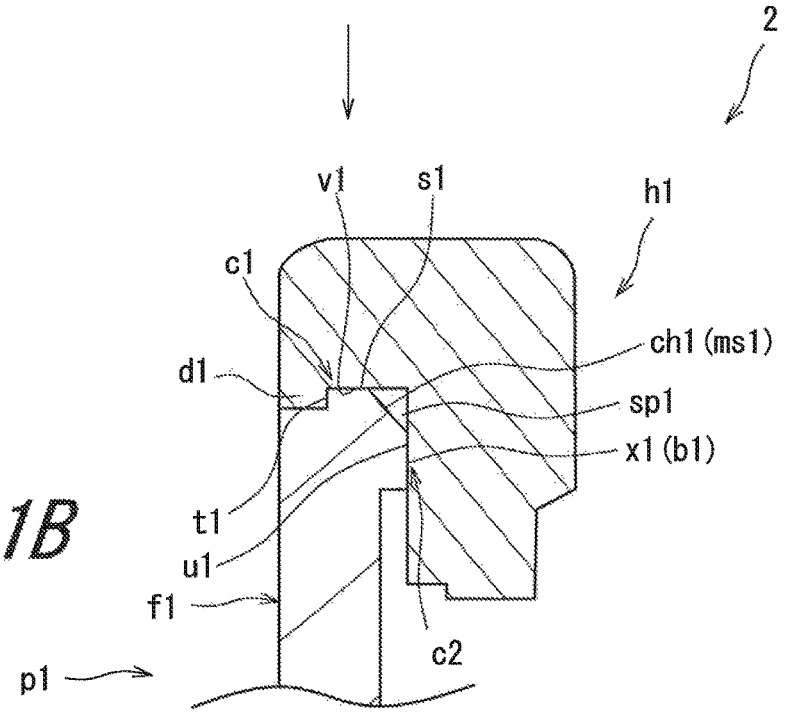
Figure 12:
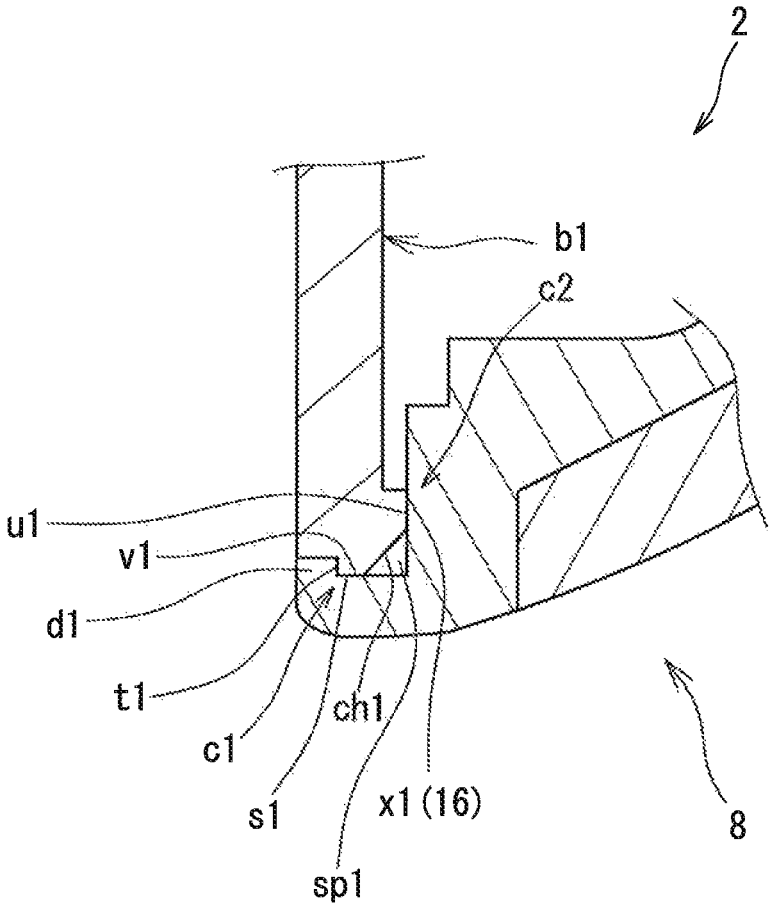
FIG. 12 is an enlarged sectional view of a head of a first embodiment.

FIGS. 10A and 10B show the procedure of attaching the face plate p1 to the head body h1. FIGS. 11A and 11B show the procedure of the formation of the plastic deforming part d1. FIG. 12 is a partial enlarged sectional view of the completed head 2. FIG. 11B is an enlarged sectional view of the upper part of the head 2, and FIG. 12 is an enlarged sectional view of the lower part of the head 2.

As shown in FIG. 5 and FIG. 10(*a*), a peripheral part of the plate front surface f1 includes a level difference surface t1 which is located at rear with respect to the hitting face (face 4). As shown in FIG. 5, the level difference surface t1 is provided over the whole circumference of the face plate p1. As shown in FIG. 11(*b*), the plastic deforming part d1 covers front of the level difference surface t1. The plastic deforming part d1 entirely covers level difference surface t1.

From the viewpoint of fixing the face plate p1, a width Wt1 (see FIG. 5) of the level difference surface t1 is preferably equal to or greater than 0.2 mm, and more preferably equal to or greater than 0.3 mm. In light of the formation of the plastic deforming part d1, the width Wt1 is preferably equal to or less than 2 mm, and more preferably equal to or less than 1 mm.

In a method for manufacturing the head 2, an undeformed body h1*p* is prepared. As shown in FIGS. 10A, 10B, and 11A, the undeformed body h1*p* includes an undeformed projection d2. Although not illustrated, the undeformed projection d2 is provided over the whole circumference of the opening part 14.

As shown in FIG. 11B, a first contact part c1 is formed by contact between the body side surface v1 and the plate side surface s1. The first contact part c1 means a portion where the body side surface v1 and the plate side surface s1 are brought into contact.

As shown in FIG. 11B, a second contact part c2 is formed by contact between the plate back surface b1 (maximum protruded part x1) and the receiving surface u1. The second contact part c2 means a portion where the plate back surface b1 (maximum protruded part x1) and the receiving surface u1 are brought into contact.

The method for manufacturing the head 2 includes the following steps:

(1) a step of press fitting the face plate p1 into the undeformed body h1*p* including the undeformed projection d2 (press fitting step); and (2) a step of crushing the undeformed projection d2 to form the plastic deforming part d1 (caulking step).

First, the press fitting step is carried out. The size of the face plate p1 is set so that friction is generated between the face plate p1 and the opening part 14 (body side surface v1). For this reason, pressure is required in order to attach the face plate p1 to the opening part 14. That is, the press fitting step is required.

The friction is generated between the plate side surface s1 and the body side surface v1. By the friction, the scraping of the plate side surface s1 and/or the body side surface v1 may be generated. In the comparison of the head body h1 with the face plate p1, lower hardness is liable to be cut. When the face plate p1 is made of a titanium alloy and the head body h1 is made of stainless steel, the stainless steel has lower hardness. Therefore, in this case, being scraped off of the body side surface v1 is likely to be generated.

As a result of the press fitting step, a stress may remain between the plate side surface s1 and the body side surface v1. In the head 2, the plate side surface s1 and the body side surface v1 press each other.

Next, the caulking step is performed. The caulking step is a step of changing the undeformed projection d2 to the plastic deforming part d1. In the step, the head obtained in the press fitting step is used. The head includes the undeformed projection d2 (FIG. 11A). As shown in FIG. 11A, in the caulking step, the undeformed projection d2 is crushed by a jig having a plane parallel to the hitting face. The undeformed projection d2 and its circumference part are plastic-deformed to move to a space located at front of the level difference surface t1. As a result, at least a part of the space located at front of the level difference surface t1 is filled, to form the plastic deforming part d1. The plastic deforming part d1 is also referred to as a caulking part. A stress may remain in the plastic deforming part d1. The plastic deforming part d1 may press the face plate p1. The plastic deforming part d1 may press the level difference surface t1.

The plastic deforming part d1 is located at front with respect to the face plate p1. The plastic deforming part d1 physically prevents the face plate p1 from coming off to front. Furthermore, since the plastic deforming part d1 is formed by plastic deformation, the plastic deforming part d1 can press the face plate p1. The plastic deforming part d1 contributes to the fixation of the face plate p1.

In the present embodiment, the undeformed projection d2 is provided over the whole circumference of the opening part 14. The whole undeformed projection d2 is plastic-deformed. As a result, the plastic deforming part d1 is provided over the whole circumference of the face plate p1. The plastic deforming part d1 may be provided on a part of the peripheral edge part of the face plate p1.

In the press fitting step, the plate side surface s1 and the body side surface v1 are rubbed against each other. The rubbing may cause shavings. The shavings may remain between the head body h1 and the face plate p1. The shavings may cause the poor attachment of the face plate p1. Examples of the poor attachment include the float of the face plate p1 and the inclination of the face plate p1. The float of the face plate p1 means a state where the amount of insertion of the face plate p1 with respect to the opening part 14 is insufficient. In this case, in the face 4 of the head 2, the plate front surface f1 of the face plate p1 is protruded from the front surface of the head body h1. The inclination of the face plate p1 is caused because the amount of insertion of the face plate p1 with respect to the opening part 14 is partially insufficient. When the face plate p1 is inclined, the plate front surface f1 is inclined with respect to the front surface of the head body h1.

The shavings may be sandwiched between the plate back surface b1 and the receiving surface u1. The shavings may be sandwiched between the plate side surface s1 and the body side surface v1. Since the face plate p1 is fixed to the head body h1, it is difficult to remove the shavings.

As shown in FIGS. 11B and 12, the present embodiment includes a hollow part sp1 for containing the shavings. The hollow part sp1 is formed by a chamfered part ch1. The hollow part sp1 is surrounded by the body side surface v1, the receiving surface u1, and the chamfered part ch1. The hollow part sp1 is a closed space. The hollow part sp1 is not opened to the outside. The hollow part sp1 forms the hollow part. The hollow part sp1 is formed by attaching the head body h1 to the face plate p1.

The chamfered part ch1 is formed in the face plate p1. The chamfered part ch1 is formed at a corner part between the plate side surface s1 and the plate back surface b1. The chamfered part ch1 is formed at a corner part between the plate side surface s1 and the maximum protruded part x1. The chamfered part ch1 is an example of a lack part ms1 in the present application.

In the present embodiment, the chamfered part ch1 is a plane. The chamfered part ch1 may be a curved surface. The chamfered part ch1 is a part of the outer peripheral edge part 16. The chamfered part ch1 is a part of the plate back surface b1.

The chamfered part ch1 is provided over the whole peripheral edge part of the face plate p1. The chamfered part ch1 may be provided on a part of the peripheral edge part of the face plate p1. A method for forming the chamfered part ch1 is not limited.

The hollow part sp1 is provided at a position adjacent to the first contact part c1. Therefore, the shavings generated by the formation of the first contact part c1 can enter into the hollow part sp1. As shown in FIG. 10A, when the face plate p1 is attached, the plate side surface s1 slides with respect to the body side surface v1. The sliding direction is rear in the front-rear direction of the head. The sliding involves pressure. In the present embodiment, the hardness of the face plate p1 is greater than the hardness of the head body h1. In this case, the head body h1 is apt to be scraped by the face plate p1. Therefore, the shavings generated by the friction between the body side surface v1 and the plate side surface s1 tend to move to rear of the first contact part c1. As shown in FIG. 10B, the hollow part sp1 is located at rear with respect to the first contact part c1. Therefore, the hollow part sp1 is likely to capture the shavings. Although not illustrated, the shavings exist in the hollow part sp1.

The hardness of the face plate p1 may be Vickers hardness. The measuring surface of the hardness is the plate side surface s1 of the face plate p1. The hardness of the head body h1 may be Vickers hardness. The measuring surface of the hardness is the body side surface v1 of the head body h1. These Vickers hardnesses are measured based on JIS Z 2244. A measuring load may be set to 98 N.

As shown in FIG. 10B, in a stage before the plastic deforming part d1 is formed, a groove-like part g1 including the level difference surface t1 as a bottom face is formed. In a step of attaching the face plate p1, the undeformed body h1*p* moves to front of the head with respect to the face plate p1. Therefore, the shavings may move to front of the first contact part c1. The shavings may be captured by the groove-like part g1. Furthermore, in the caulking step, the plastic deforming part d1 is formed in the groove-like part g1. The shavings captured by the groove-like part g1 may be covered with the plastic deforming part d1. As a result, the shavings are hidden by the plastic deforming part d1. From this viewpoint, the plastic deforming part d1 is preferably located at front with respect to the hollow part sp1.

Thus, the chamfered part ch1 plays a role of forming the hollow part sp1 capturing the shavings. In addition, the chamfered part ch1 plays a role of guiding the face plate p1 to the opening part 14 of the head body h1 in the press fitting step. The chamfered part ch1 facilitates the press fitting of the face plate p1, and the chamfered part can suppress poor press fitting in the press fitting step.

As described above, the second contact part c2 is formed by contact between the plate back surface b1 (maximum protruded part x1) and the receiving surface u1. If the shavings are sandwiched in the second contact part c2, the float of the face plate p1 is generated. The hollow part sp1 is provided at a position adjacent to the second contact part c2. This suppresses the shavings from being sandwiched in the second contact part c2, and the poor attachment of the face plate p1 I suppressed.

In the press fitting step, the rubbing between the plate side surface s1 and the body side surface v1 is generated. For this reason, the plate side surface s1 may have scuffs generated by the friction between the plate side surface s1 and the body side surface v1. Similarly, the body side surface v1 may have scuffs generated by the friction between the body side surface v1 and the plate side surface s1. These scuffs can be confirmed by removing the face plate p1 from the head body h1, and observing the surfaces of the plate side surface s1 and the body side surface v1.

Figure 13:
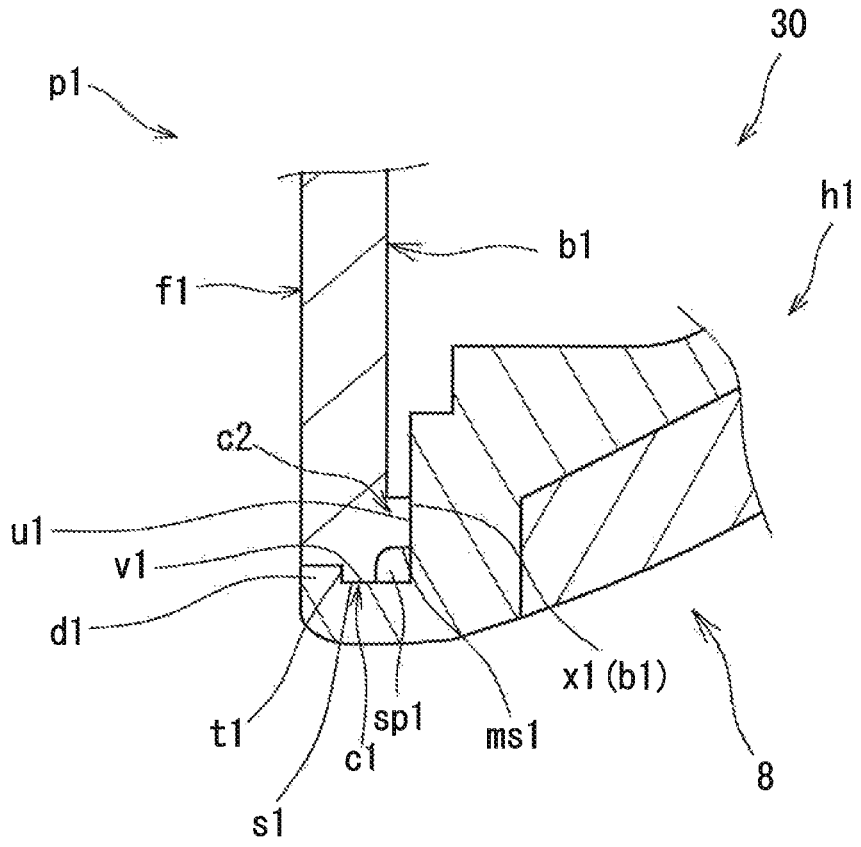
FIG. 13 is an enlarged sectional view of a head of a second embodiment.

FIG. 13 is a sectional view of a head 30 according to a second embodiment. Except for the shape of a hollow part sp1, the head 30 is the same as the head 2.

The head 30 includes a head body h1 and a face plate p1 fixed to the head body h1. The face plate p1 includes a plate front surface f1, a plate back surface b1, and a plate side surface s1. The plate front surface f1 has a hitting face. The hitting face is a plane except for face grooves. The plate back surface b1 is a surface opposite to the plate front surface f1. The plate side surface s1 extends between the plate front surface f1 and the plate back surface b1.

The head body h1 includes a receiving surface u1 which supports the plate back surface b1 of the face plate p1, and a body side surface v1 which is opposed to the plate side surface s1. The head body h1 supports the face plate p1 (plate back surface b1) from rear. The plate back surface b1 includes a maximum protruded part x1. The maximum protruded part x1 abuts on the receiving surface u1. The whole receiving surface u1 is constituted by a single plane. The body side surface v1 is provided over the whole circumference of the opening part 14. A part of the plate back surface b1 is brought into contact with the receiving surface u1. As described above, the face plate p1 is press fitted into the head body h1. For this reason, a pressing force acts between the body side surface v1 and the plate side surface s1. That is, the body side surface v1 and the plate side surface s1 are in a relation pressing each other.

The head 30 includes the hollow part sp1. The hollow part sp1 can contain the shavings. The hollow part sp1 is formed by a lack part ms1. The hollow part sp1 is surrounded by the body side surface v1, the receiving surface u1, and the lack part ms1. The hollow part sp1 is a closed space. The hollow part sp1 is not opened to the outside.

The lack part ms1 is formed in the face plate p1. The lack part ms1 is formed at a corner part between the plate side surface s1 and the plate back surface b1. The lack part ms1 is formed at a corner part between the plate side surface s1 and the maximum protruded part x1.

In the present embodiment, the lack part ms1 is a recess-curved surface. The shape of the lack part ms1 is not limited. The lack part ms1 may be a projectingly-curved surface, for example.

The lack part ms1 is provided over the whole peripheral edge part of the face plate p1. The lack part ms1 may be provided on a part of the peripheral edge part of the face plate p1. A method for forming the lack part ms1 is not limited.

As described above, a first contact part c1 is formed by contact between the body side surface v1 and the plate side surface s1. The hollow part sp1 is provided at a position adjacent to the first contact part c1. Therefore, shavings generated by the formation of the first contact part c1 can enter into the hollow part sp1. When the face plate p1 is attached, the plate side surface s1 slides with respect to the body side surface v1. The sliding direction is rear in the front-rear direction of the head. In addition, when the hardness of the face plate p1 is greater than the hardness of the head body h1, the head body h1 is apt to be scraped. Therefore, the shavings generated by the friction between the body side surface v1 and the plate side surface s1 tend to move to rear of the first contact part c1. As shown in FIG. 13, the hollow part sp1 is located at rear with respect to the first contact part c1. Therefore, the hollow part sp1 is likely to capture the shavings.

As described above, a second contact part c2 is formed by contact between the plate back surface b1 (maximum protruded part x1) and the receiving surface u1. If the shavings are sandwiched in the second contact part c2, the float of the face plate p1 is generated. The hollow part sp1 is provided at a position adjacent to the second contact part c2. This suppresses the shavings from being sandwiched in the second contact part c2, and the poor attachment of the face plate p1 is suppressed.

Figure 14:
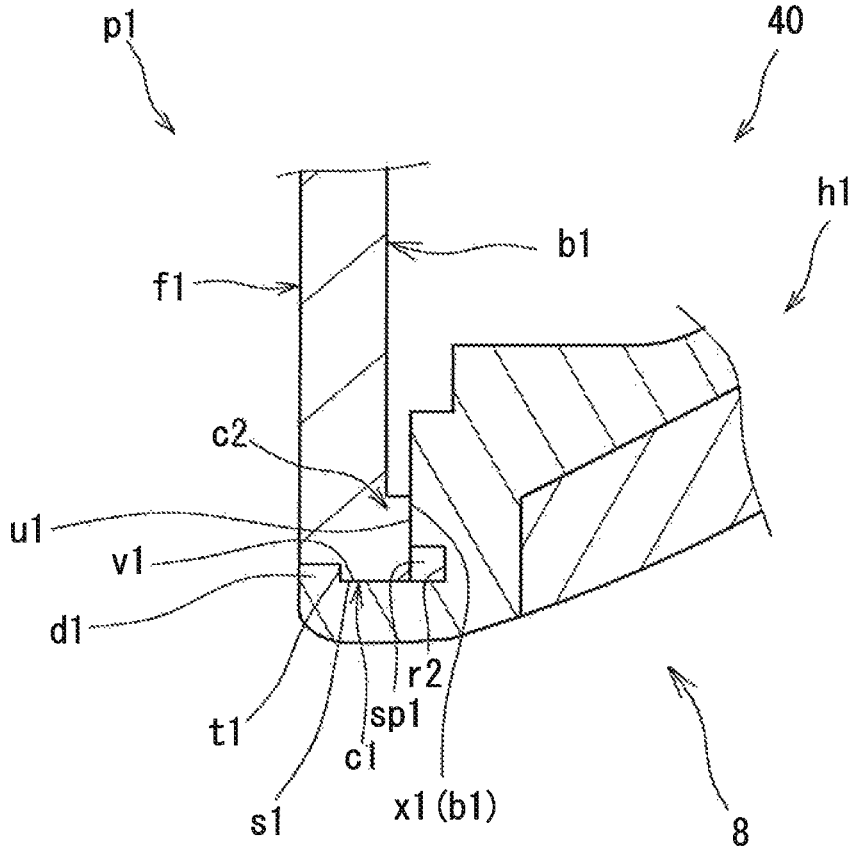
FIG. 14 is an enlarged sectional view of a head of a third embodiment.

FIG. 14 is a sectional view of a head 40 according to a third embodiment. Except for the position of a hollow part sp1, the head 40 is the same as the head 2.

The head 40 includes a head body h1 and a face plate p1 fixed to the head body h1. The face plate p1 includes a plate front surface f1, a plate back surface b1, and a plate side surface s1. The plate front surface f1 has a hitting face. The hitting face is a plane except for face grooves. The plate back surface b1 is a surface opposite to the plate front surface f1. The plate side surface s1 extends between the plate front surface f1 and the plate back surface b1. The head body h1 includes a receiving surface u1 which supports the plate back surface b1 of the face plate p1, and a body side surface v1 which is opposed to the plate side surface s1.

The head body h1 supports the face plate p1 (plate back surface b1) from rear. The plate back surface b1 includes a maximum protruded part x1. The maximum protruded part x1 abuts on the receiving surface u1. The whole receiving surface u1 is constituted by a single plane. The body side surface v1 is provided over the whole circumference of the opening part 14. A part of the plate back surface b1 is brought into contact with the receiving surface u1. As described above, the face plate p1 is press fitted into the head body h1. For this reason, a pressing force acts between the body side surface v1 and the plate side surface s1. That is, the body side surface v1 and the plate side surface s1 are in a relation pressing each other.

The head 40 includes the hollow part sp1. The hollow part sp1 can contain the shavings. The receiving surface u1 of the head body h1 includes a recess r2. The recess r2 forms the hollow part sp1. In order to distinguish the recess r2 from another recess, in the present application, the recess r2 is also referred to as a second recess.

The hollow part sp1 is surrounded by the second recess r2 and the plate back surface b1. The hollow part sp1 is a closed space. The hollow part sp1 is not opened to the outside.

The second recess r2 is formed in the head body h1. The second recess r2 is adjacent to a corner part between the plate side surface s1 and the plate back surface b1. The hollow part sp1 is adjacent to a corner part between the plate side surface s1 and the plate back surface b1.

In the present embodiment, the second recess r2 is a groove having a square sectional shape. The sectional shape of the second recess r2 is not limited.

The second recess r2 is provided over the whole peripheral edge part of the receiving surface u1. The second recess r2 may be provided on a part of the peripheral edge part of the receiving surface u1. A method for forming the second recess r2 is not limited.

A first contact part c1 is formed by contact between the body side surface v1 and the plate side surface s1. The hollow part sp1 is provided at a position adjacent to the first contact part c1. Therefore, shavings generated by the formation of the first contact part c1 can enter into the hollow part sp1. When the face plate p1 is attached, the plate side surface s1 slides with respect to the body side surface v1. The sliding direction is rear in the front-rear direction of the head. In addition, when the hardness of the face plate p1 is greater than the hardness of the head body h1, the head body h1 is apt to be scraped. Therefore, the shavings generated by the friction between the body side surface v1 and the plate side surface s1 tend to move to rear of the first contact part c1. As shown in FIG. 14, the hollow part sp1 is located at rear with respect to the first contact part c1. Therefore, the hollow part sp1 is likely to capture the shavings.

A second contact part c2 is formed by contact between the plate back surface b1 (maximum protruded part x1) and the receiving surface u1. If the shavings are sandwiched in the second contact part c2, the float of the face plate p1 is generated. The hollow part sp1 is provided at a position adjacent to the second contact part c2. This suppresses the shavings from being sandwiched in the second contact part c2, and the poor attachment of the face plate p1 is suppressed.

Figure 15:
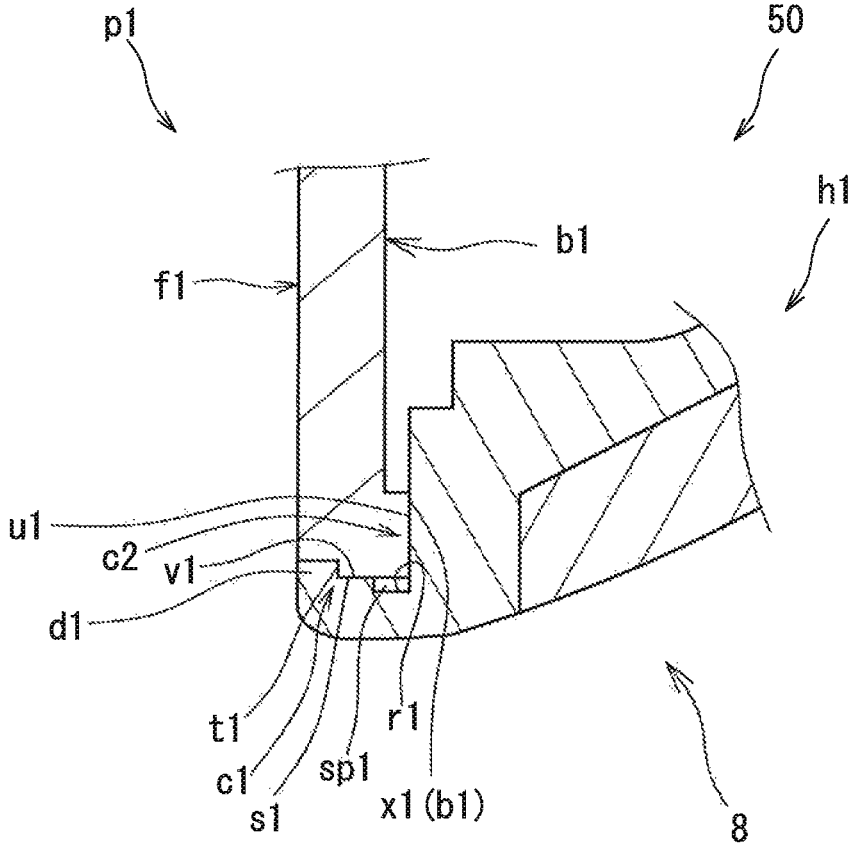
FIG. 15 is an enlarged sectional view of a head of a fourth embodiment.

FIG. 15 is a sectional view of a head 50 according to a fourth embodiment. Except for the position of a hollow part sp1, the head 50 is the same as the head 2.

The head 50 includes a head body h1 and a face plate p1 fixed to the head body h1. The face plate p1 includes a plate front surface f1, a plate back surface b1, and a plate side surface s1. The plate front surface f1 has a hitting face. The hitting face is a plane except for face grooves. The plate back surface b1 is a surface opposite to the plate front surface f1. The plate side surface s1 extends between the plate front surface f1 and the plate back surface b1. The head body h1 includes a receiving surface u1 which supports the plate back surface b1 of the face plate p1, and a body side surface v1 which is opposed to the plate side surface s1.

The head body h1 supports the face plate p1 (plate back surface b1) from rear. The plate back surface b1 includes a maximum protruded part x1. The maximum protruded part x1 abuts on the receiving surface u1. The whole receiving surface u1 is constituted by a single plane. The body side surface v1 is provided over the whole circumference of the opening part 14. A part of the plate back surface b1 is brought into contact with the receiving surface u1. As described above, the face plate p1 is press fitted into the head body h1. For this reason, a pressing force acts between the body side surface v1 and the plate side surface s1. That is, the body side surface v1 and the plate side surface s1 are in a relation pressing each other.

The head 50 includes the hollow part sp1. The hollow part sp1 can contain the shavings. The body side surface v1 of the head body h1 includes a recess r1. The recess r1 forms the hollow part sp1. In order to distinguish the recess r1 from another recess, in the present application, the recess r1 is also referred to as a first recess.

The hollow part sp1 is surrounded by the first recess r1 and the plate side surface s1. The hollow part sp1 is a closed space. The hollow part sp1 is not opened to the outside.

The first recess r1 is formed in the head body h1. The first recess r1 is adjacent to a corner part between the plate side surface s1 and the plate back surface b1.

In the present embodiment, the first recess r1 is a groove having a square sectional shape. The sectional shape of the first recess r1 is not limited.

The first recess r1 is provided over the whole circumference of the body side surface v1. The first recess r1 may be provided in a part of the peripheral direction of the body side surface v1. A method for forming the first recess r1 is not limited.

A first contact part c1 is formed by contact between the body side surface v1 and the plate side surface s1. The hollow part sp1 is provided at a position adjacent to the first contact part c1. Therefore, shavings generated by the formation of the first contact part c1 can enter into the hollow part sp1. When the face plate p1 is attached, the plate side surface s1 slides with respect to the body side surface v1. The sliding direction is rear in the front-rear direction of the head. In addition, when the hardness of the face plate p1 is greater than the hardness of the head body h1, the head body h1 is apt to be scraped. Therefore, the shavings generated by the friction between the body side surface v1 and the plate side surface s1 tend to move to rear of the first contact part c1. As shown in FIG. 15, the hollow part sp1 is located at rear with respect to the first contact part c1. Therefore, the hollow part sp1 is likely to capture the shavings.

A second contact part c2 is formed by contact between the plate back surface b1 (maximum protruded part x1) and the receiving surface u1. If the shavings are sandwiched in the second contact part c2, the float of the face plate p1 is generated. The hollow part sp1 is provided at a position adjacent to the second contact part c2. This suppresses the shavings from being sandwiched in the second contact part c2, and the poor attachment of the face plate p1 is suppressed.

When the above-mentioned four embodiments are compared, the capturing properties of shavings of the head 2 (FIG. 12), the head 30 (FIG. 13), and the head 40 (FIG. 14) are particularly higher than the capturing property of shavings of the head 50 (FIG. 15). In the head 2, the head 30, and the head 40, the hollow part sp1 is located between the plate back surface b1 and the receiving surface u1. Meanwhile, in the head 50, the hollow part sp1 is not located between the plate back surface b1 and the receiving surface u1. In the head 50, the hollow part sp1 is located between the body side surface v1 and the plate side surface s1. In the head 50 as compared with the heads 2, 30, and 40, the shavings may be apt to be sandwiched between the plate back surface b1 and the receiving surface u1.

The peripheral length of the face plate p1 is defined as Lp, and the extension length of the hollow part sp1 is defined as Ls. The length Lp is the length of a contour line 20 of the plate back surface b1. The extension length Ls is the length of the outer edge of the hollow part sp1 when the hollow part sp1 is seen through in planar view as shown in FIG. 3. When a plurality of hollow parts sp1 exist, the total of the lengths of the outer edge of the hollow parts sp1 is the length Ls.

From the viewpoint of the capturing property of shavings, Ls/Lp is preferably equal to or greater than 0.3, more preferably equal to or greater than 0.5, still more preferably equal to or greater than 0.7, yet still more preferably equal to or greater than 0.9, and even yet still more preferably 1. In the embodiment, Ls/Lp is 1.

When Ls/Lp is less than 1, the position of the hollow part sp1 is not limited. From the viewpoint of the capturing property of shavings, the hollow part sp1 is preferably provided in two or more regions selected from the group consisting of the toe-side region, the heel-side region, the top-side region, and the sole-side region. From the viewpoint of the capturing property of shavings, the hollow part sp1 is more preferably provided in three or more regions selected from the group consisting of the toe-side region, the heel-side region, the top-side region, and the sole-side region. From the viewpoint of the capturing property of shavings, the hollow part sp1 is still more preferably provided in each of the toe-side region, the heel-side region, the top-side region, and the sole-side region.

From the viewpoint of the capturing property of shavings, the sectional area of the hollow part sp1 is preferably equal to or greater than 0.1 $mm^2$, more preferably equal to or greater than 0.2 $mm^2$, and still more preferably equal to or greater than 0.5 $mm^2$. In light of the strength of the head, the sectional area of the hollow part sp1 is preferably equal to or less than 9 $mm^2$, more preferably equal to or less than 7 $mm^2$, and still more preferably equal to or less than 5 $mm^2$. The sectional area of the hollow part sp1 is measured in a section along a plane perpendicular to a plane constituting the hitting face.

EXAMPLES

Hereinafter, the effects of the present invention will be clarified by Example. However, the present invention should not be interpreted in a limited way based on the description of Example.

Example

The same head as the above-mentioned head 2 was produced. A face plate p1 and a head body (undeformed body) h1*p* were prepared. The head body h1*p* was produced by casting. The head body h1*p* included an undeformed projection d2. The undeformed projection d2 was formed on the whole circumference of an opening part 14. The head body h1*p* was made of stainless steel (SUS630). The face plate p1 was cut from a plate material (rolling material). A maximum protruded part x1 was produced by an NC process. The face plate p1 was made of a titanium alloy. As the titanium alloy, Super-TIX (registered trademark) manufactured by Nippon Steel & Sumitomo Metal Corporation was used. The peripheral edge of the plate back surface b1 was cut to form a chamfered part ch1. The face plate p1 was press fitted into the opening part 14 of the head body h1*p* by the above-mentioned press fitting step. Next, by performing the above-mentioned caulking step, the undeformed projection d2 was shifted to a plastic deforming part d1. Thus, a head of Example was obtained.

In the press fitting step of this Example, a chamfered part ch1 functioned as a guiding part. For this reason, the press fitting of the face plate p1 was smooth and easy. When the head of Example was cut by a cutter, and the inside of the hollow part sp1 was confirmed, shavings existed in the hollow part sp1.

As described above, the advantages of the present invention are apparent.

The description hereinabove is merely for an illustrative example, and various modifications can be made in the scope not to depart from the principles of the present invention.

The present invention can be applied to all golf club heads such as a wood type head, a utility type head, a hybrid type head, an iron type head, and a putter head.

What is claimed is:

1. A golf club head comprising:

a head body; and a face plate fixed to the head body, wherein:

the face plate includes a plate front surface having a hitting face, a plate back surface which is a surface opposite to the plate front surface, and a plate side surface;

the head body includes a body side surface opposed to the plate side surface, and a receiving surface which supports the face plate from rear;

a first contact part is formed by contact between the body side surface and the plate side surface; and a hollow part is provided at a position adjacent to the first contact part, wherein a sectional area of the hollow part is equal to or greater than 0.1 $mm^2$ but equal to or less than 9 $mm^2$.

2. The golf club head according to claim 1, wherein:

a second contact part is formed by contact between the plate back surface and the receiving surface; and the hollow part is provided at a position adjacent to the second contact part.

3. The golf club head according to claim 1, wherein:

the face plate includes a lack part formed at a corner part between the plate side surface and the plate back surface; and the lack part forms the hollow part.

4. The golf club head according to claim 3, wherein the lack part is a chamfered part.

5. The golf club head according to claim 1, wherein:

the head body includes a first recess in the body side surface; and the first recess forms the hollow part.

6. The golf club head according to claim 1, wherein:

the head body includes a second recess in the receiving surface; and the second recess forms the hollow part.

7. The golf club head according to claim 1, wherein the hollow part is provided between the plate back surface and the receiving surface.

8. The golf club head according to claim 1, further comprising shavings generated between the body side surface and the plate side surface, wherein the shavings exist in the hollow part.

9. The golf club head according to claim 1, wherein the plate side surface and the body side surface press each other in the first contact part.

10. The golf club head according to claim 1, wherein a hardness of the face plate is greater than a hardness of the head body.

11. The golf club head according to claim 1, wherein the hollow part is located at rear with respect to the first contact part.

12. The golf club head according to claim 1, wherein the hollow part is provided in two or more regions selected from the group consisting of a toe-side region of the head, a heel-side region of the head, a top-side region of the head, and a sole-side region of the head.

13. A golf club head comprising:

a head body; and a face plate fixed to the head body, wherein:

the face plate includes a plate front surface having a hitting face, a plate back surface which is a surface opposite to the plate front surface, and a plate side surface;

the head body includes a body side surface opposed to the plate side surface, and a receiving surface which supports the face plate from rear;

a first contact part is formed by contact between the body side surface and the plate side surface; and a hollow part is provided at a position adjacent to the first contact part, wherein:

the head body includes a first recess in the body side surface; and the first recess forms the hollow part.

14. A golf club head comprising:

a head body; and a face plate fixed to the head body, wherein:

the face plate includes a plate front surface having a hitting face, a plate back surface which is a surface opposite to the plate front surface, and a plate side surface;

the head body includes a body side surface opposed to the plate side surface, and a receiving surface which supports the face plate from rear;

a first contact part is formed by contact between the body side surface and the plate side surface; and a hollow part is provided at a position adjacent to the first contact part, wherein:

the head body includes a recess in the receiving surface; and the recess forms the hollow part.

* * * * *